US010519571B2

(12) United States Patent
Gualtieri

(10) Patent No.: US 10,519,571 B2
(45) Date of Patent: Dec. 31, 2019

(54) CARDING MACHINE COMPRISING A ROTARY ELEMENT

(71) Applicant: TECHNOPLANTS S.r.l., Prato (PO) (IT)

(72) Inventor: Marco Gualtieri, Prato (IT)

(73) Assignee: TECHNOPLANTS S.R.L., Prato (IT)

( * ) Notice: Subject to any disclaimer, the term of this patent is extended or adjusted under 35 U.S.C. 154(b) by 114 days.

(21) Appl. No.: 15/557,529

(22) PCT Filed: Mar. 10, 2016

(86) PCT No.: PCT/IB2016/051360
§ 371 (c)(1),
(2) Date: Sep. 12, 2017

(87) PCT Pub. No.: WO2016/142896
PCT Pub. Date: Sep. 15, 2016

(65) Prior Publication Data

US 2018/0051400 A1 Feb. 22, 2018

(30) Foreign Application Priority Data

Mar. 12, 2015 (IT) ..... FI2015A0070

(51) Int. Cl.
*D01G 15/46* (2006.01)

(52) U.S. Cl.
CPC ..... *D01G 15/465* (2013.01)

(58) Field of Classification Search
CPC .. D01G 15/465; D01G 15/763; D01G 15/785; D01G 15/805; D01G 15/825
See application file for complete search history.

(56) References Cited

U.S. PATENT DOCUMENTS 2,987,779 A * 6/1961 Kawashima ..... D01G 15/465 19/106 R
3,641,628 A * 2/1972 Fehrer ..... D01G 15/465 19/307
5,303,455 A * 4/1994 Leifeld ..... D01G 9/18 19/105
7,003,853 B2 * 2/2006 Bernhardt ..... D01G 15/465 19/296

OTHER PUBLICATIONS

Patent Cooperation Treaty, International Search Report for PCT/IB2016/051360 dated Jun. 13, 2016, 4 pages.
Patent Cooperation Treaty, Written Opinion of the International Searching Authority for PCT/IB2016/051360 dated Jun. 13, 2016, 7 pages.

* cited by examiner

*Primary Examiner* — Clinton T Ostrup
*Assistant Examiner* — Andrew Wayne Sutton
(74) *Attorney, Agent, or Firm* — Heslin Rothenberg Farley & Mesiti P.C.

(57) ABSTRACT

Described is a carding machine designed preferably to operate in a system for producing padding, which has a particular variability in the type of air processing which may be performed by the machine on the fibres, together with a greater simplicity of management of the configuration of the machine compared with prior art systems.

11 Claims, 4 Drawing Sheets

CARDING MACHINE COMPRISING A ROTARY ELEMENT

CROSS REFERENCE TO RELATED APPLICATIONS

This application is a national stage filing under section 371 of International Application No. PCT/IB2016/051360, filed on Mar. 10, 2016, published in English on Sep. 15, 2016 as WO2016/142896A1 which claims priority to IT Application No. FI2015A000070, filed on Mar. 12, 2015, the entire disclosure of these applications being hereby incorporated herein by reference.

TECHNICAL FIELD

This invention relates to a carding machine designed preferably to operate in a system for producing padding, which has a particular variability in the type of air processing which may be performed by the machine on the fibres, together with a greater simplicity of management of the configuration of the machine compared with prior art systems.

BACKGROUND ART

In the field of producing padding, in particular for mattresses, the carding machine is used in particular for combing, separating and parallelising the discontinuous fibres which will then be used to create the padding, and for varying the thickness of the layer of fibres which is obtained by the same operations performed by the machine.

These operations are performed by purely mechanical machining and by machining of the pneumatic or "air" type, which are performed with suction means and/or blowers designed to model the thickness of the overall layer of fibres and their mutual configuration.

More specifically, a possible carding machine, to which this invention is advantageously applicable, comprises a first rotary working element, also called the licker-in, and a second rotary working element, also called the drum. These elements work the fibres by passing them along a working path which comprises stretches or sectors tangential to the licker-in and drum and which preferably pass along at least one intermediate zone or intermediate "point" interposed between the licker-in and drum, and at which the working of the fibres may also be very intense.

The air processing, on the other hand, is commonly carried out by the passage of the fibres in the vicinity of suction means which add volume to the layer or stream of fibres and determine, for example, an increase in thickness. More specifically, the fibres worked mechanically are conveyed, if necessary with the aid of blower means, on a conveying surface which translates in the vicinity of at least one suction device, in such a way that the fibres can be subjected to the action of the suction device.

In order to modify the effect of the air processing the operators usually act on the suction power of the at least one suction means and on its rotation speed, as well as on the power of any blower means.

The Applicant has found that the versatility and/or flexibility of the air processing may be improved.

Moreover, the Applicant has found that a reduction can be obtained in the time necessary to make the modifications to the configuration of the machine which are necessary to vary the effects produced on the fibres by the air processing means.

DISCLOSURE OF THE INVENTION

The aim of this invention is to provide a carding machine by means of which it is possible to obtain an increase in the air machining flexibility which the machine can perform on the fibres.

Another aim of the invention is to provide a carding machine where the flexibility is also associated with a greater speed of the operations necessary to modify the configuration of the machine.

These aims are obtained by a carding machine comprising a first rotary element, or licker-in, a second rotary element, or drum, first suction means and a conveying surface designed to define a path for working the fibres tangential partly to the licker-in, partly to the drum and partly to the conveying surface, the conveying surface being designed to receive fibres arriving from the drum and to translate along at least one direction of translation, the working path comprising a suction sector tangential to the conveying surface and interposed at least partly between the conveying surface and the first suction means, the first suction means being designed to act at the suction sector, characterised in that the conveying surface may adopt several operating conditions in such a way as to vary the extension, in a direction at right angles to the conveying surface, of at least one suction section relative to the suction sector.

A possible embodiment of the invention may comprise at least one of the following technical aspects.

Preferably, the variation of the operating condition adopted by the conveying surface is associated with the variation of the distance between the first suction means and the conveying surface.

Due to the fact that the suction sector, which is a part of the working path of the fibres, is situated at least partly between the conveying surface and the first suction means, the change of operating condition of the conveying surface determines an extension or a reduction of at least one section of the suction sector. The suction effect which the first suction means produces on the fibres which translate along the suction sector therefore undergoes a variation as a result of the variation of the operating condition adopted by the conveying surface.

Preferably, the working path comprises an intermediate sector designed to be passed along by the action of gravity by fibres coming from the drum in such a way that the fibres reach the suction sector.

Preferably, the machine comprises blower means designed to act at the intermediate sector.

Preferably, the blower means face towards the conveying surface in such a way as to push the fibres towards the conveying surface.

Preferably, the first suction means comprises a first rotary suction device.

Thanks to the possibility to rotate, the first suction means are designed also to contribute to the movement of the fibres in the direction of translation of the conveying surface.

Preferably, the machine comprises second suction means designed to act at the suction sector and located on the opposite part of the conveying surface relative to the first suction means.

The second suction means act in conjunction with the first suction means to amplify the effect of the first suction means on the volume of the layer of fibres, in particular thanks to the positioning of the second suction means which are on the opposite side of the conveying surface relative to the first suction means, and therefore act on the fibres in a direction at least partly opposite that of the first suction means.

Preferably, the machine comprises pneumatic energy recovery means designed to act between the first suction means and the blower means and/or between the second suction means and the blower means. Preferably, the energy recovery means comprise at least one duct which connects the first suction means to the blower means and/or the second suction means to the blower means and, if necessary, at least one valve designed to vary the height which is recirculated, relative to the flow drawn by the first suction means and/or by the second suction means, and thus also the height of the flow which is discharged outside the machine.

Preferably, the machine comprises means for moving the conveying surface which are designed to modify the operating condition.

Preferably, the movement means are designed to rotate the conveying surface at least on a plane of rotation shared by the licker-in and the drum, and about a centre of rotation located downstream of the conveying surface along the working path.

The operating condition of the conveying surface is modified by rotating it, in order to meet the need to change the operating condition with the presence of other components of the production plant. In effect, it is preferable that these components, which must then receive the worked fibres, remain fixed with the variation of the operating condition of the conveying surface.

In a specific method for using a machine according to this invention, the licker-in and the drum rotate on at least a same shared plane of rotation.

Preferably, according to this method the licker-in and the drum rotate in a mutually inverse manner.

Preferably according to this method, the direction of translation of the conveying surface and the working path of the fibres lie at least partly on the shared plane of rotation, or in any case are at least partly parallel to the same plane.

Preferably, according to this method, the first suction means rotate at least on the shared plane of rotation.

BRIEF DESCRIPTION OF THE DRAWINGS

The features of this invention are described in detail below relating to a particular embodiment of the invention to be considered by way of a non-limiting example of the more general concepts claimed.

The detailed description which follows relates to the accompanying drawings, in which.

DETAILED DESCRIPTION OF PREFERRED EMBODIMENTS OF THE INVENTION

Figure 1:
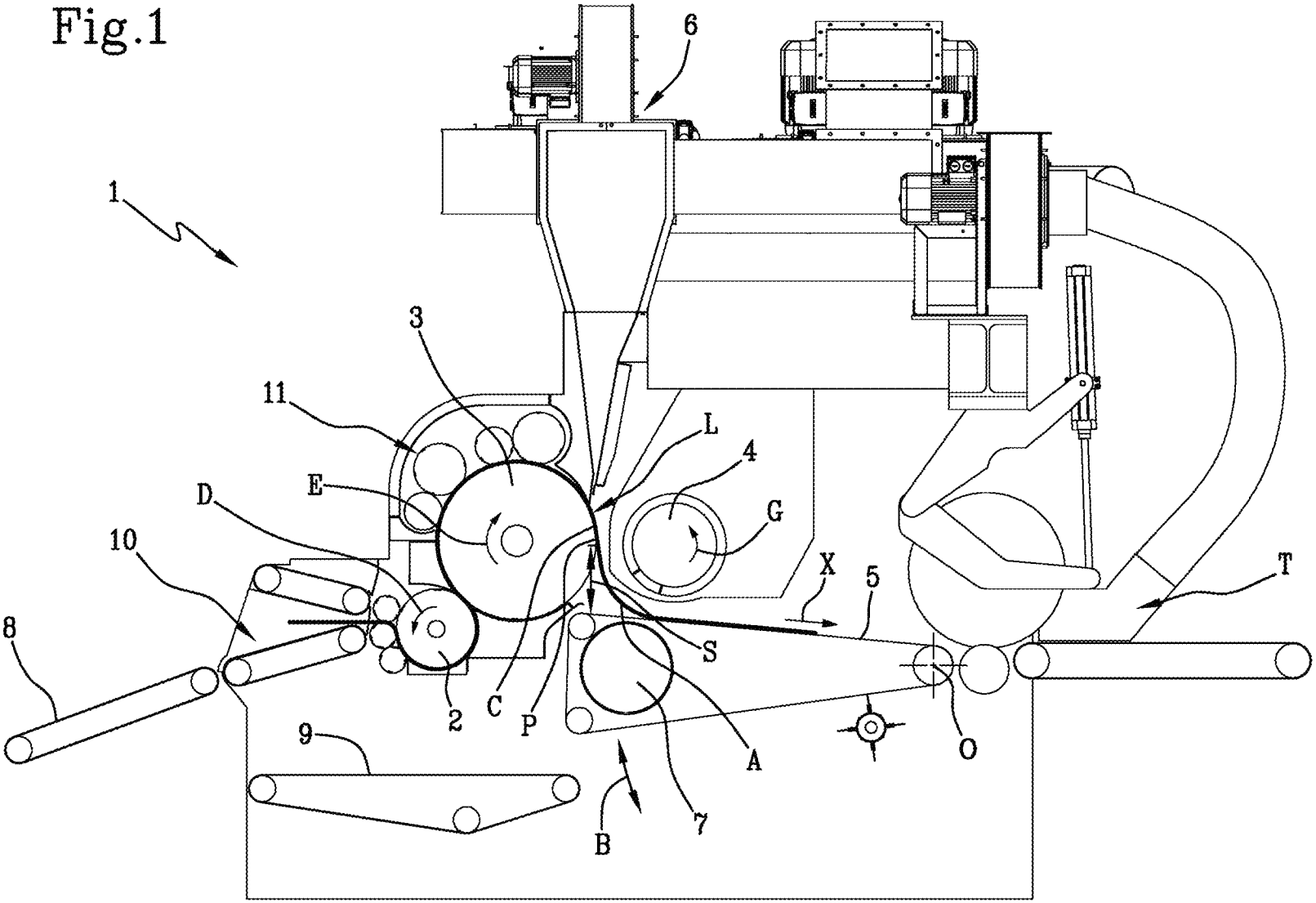
FIG. 1 is a side view of a first operating configuration of a particular embodiment of this invention.

FIG. 1 shows a carding machine 1 according to this invention, comprising a first rotary element, or licker-in 2, a second rotary element, or drum 3, first suction means 4 and a conveying surface 5. The licker-in 2, drum 3, first suction means 4 and conveying surface 5 are designed to define a working path L of the fibres tangential partly to the licker-in 2, partly to the drum 3 and partly to the conveying surface 5.

The conveying surface 5 is designed to receive fibres arriving from the drum 3 and to translate and/or slide along at least a direction of translation X. The working path L comprises a suction sector A interposed at least partly between the conveying surface 5 and the first suction means 4. The first suction means 4 are designed to act above the suction sector A.

Figure 2:
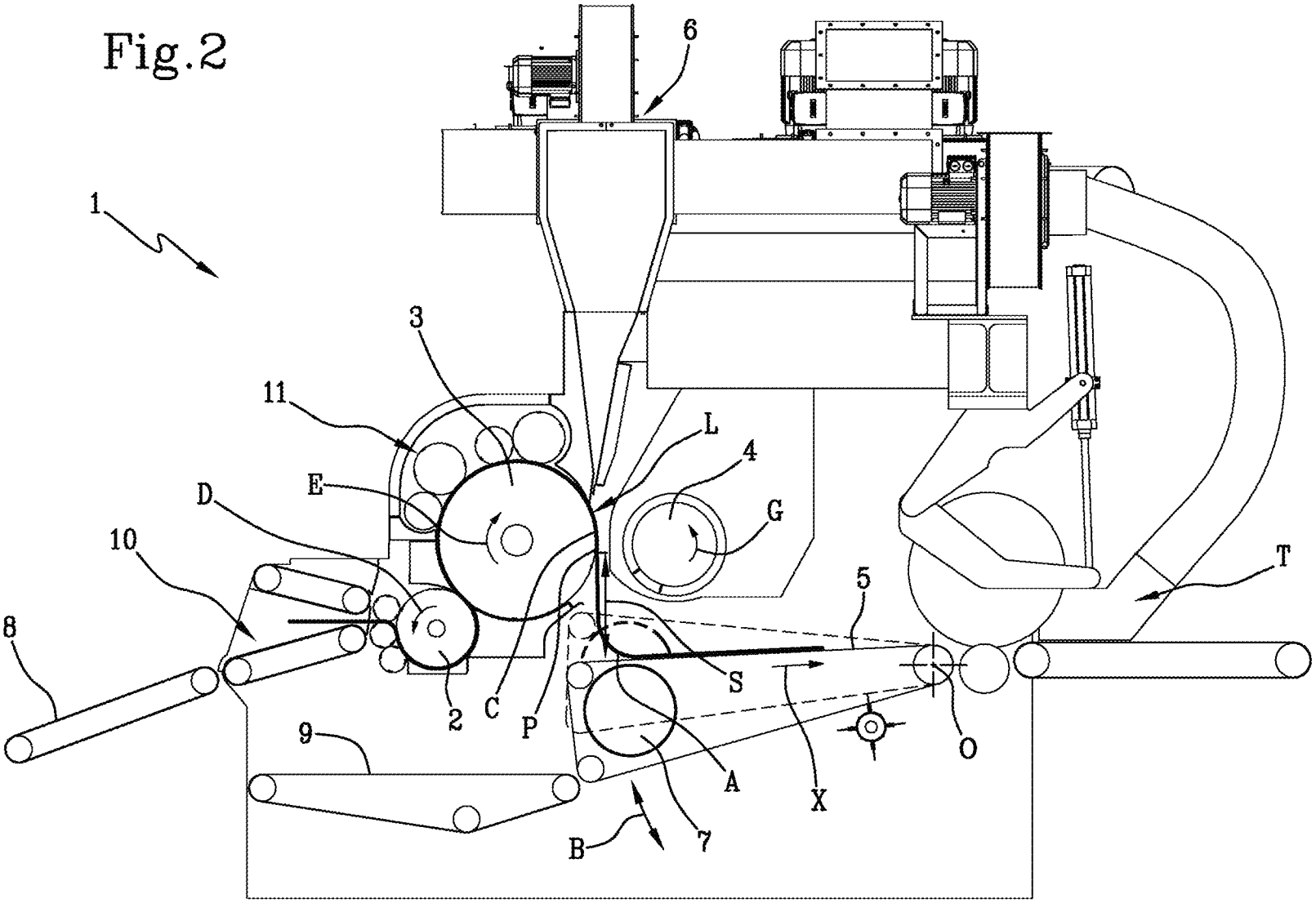
FIG. 2 is a side view of the embodiment in a second operating configuration.

The conveying surface 5 may adopt several operating conditions in such a way as to vary the relative inclination, for varying the suction section S relative to the suction sector A, as shown clearly for example in FIG. 2.

As may be noted in particular by comparing FIGS. 1 and 2, the variation of the operating condition adopted by the conveying surface 5 is associated with the variation of the distance between the detachment point from the drum 3 and the conveying surface 5.

The working path L, in the embodiment illustrated of the machine 1, comprises an intermediate sector C interposed between the drum 3 and the suction sector A. This intermediate sector C is designed to be passed along by the action of gravity by the fibres arriving from the drum 3, and, basically, is designed to be passed along by the fibres arriving from the drum 3. These fibres, after have covered the intermediate sector, pass along the suction sector A.

Due to the fact that the suction sector A, which is a part of the working path L of the fibres, is situated at least partly between the conveying surface 5 and the first suction means 4, the change of operating condition of the conveying surface 5 determines an extension or a reduction of at least one section S of the suction sector A.

The expression section S of the suction sector A means a section transversal to the working path L, located at the suction sector A, which is a part of the working path L. The working path L, on the plane at right angles to the motion of the fibres associated with the working path L, defines in effect a section with a certain two-dimensional extension.

The suction effect which the first suction means 4 produces on the fibres which translate along the suction sector A therefore undergoes a variation as a result of the variation of the operating condition adopted by the conveying surface 5. In effect, if the cross section S of the suction sector A increases, there will be an increase in the thickness of the layer of fibres which moves along the suction sector A.

The working path L is indicated in FIGS. 1 and 2 in a very schematic manner; in effect the thickness of the working path L at the suction sector A does not cover the entire suction section S. In other words, the working path L is illustrated in order to show the trajectory which is covered by the fibres, without taking into account the extension of the path L transversal to the main motion of the fibres.

The machine 1 advantageously comprises blower means 6 designed to act at the intermediate sector C. The blower means 6 preferably face towards the conveying surface 5, in such a way as to push the fibres towards the conveying surface 5.

In the embodiment illustrated, the first suction means 4 comprise a first rotary suction device 4. Moreover, the first suction means 4 are preferably cylindrical.

Thanks to the possibility to rotate, the first suction means 4 are designed also to contribute to the movement of the fibres in the direction of translation and/or sliding X of the conveying surface 5.

The machine advantageously comprises second suction means 7 designed to act at the same suction sector A, but located on the opposite part of the conveying surface 5 relative to the first suction means 4. In the embodiment illustrated, the second suction means 7 are also preferably cylindrical.

The machine 1 advantageously comprises pneumatic energy recovery means, which are not illustrated in the drawings. The recovery means are designed to act between the first suction means 4 and the blower means 6, and/or between the second suction means 7 and the blower means 6. The energy recovery means preferably comprise at least one duct which connects the blower means 6 to the first suction means 4 and/or to the second suction means 7.

These recovery means advantageously comprise at least one valve designed to vary the flow height which is recirculated, relative to the flow drawn by the first suction means 4 and/or by the second suction means 7. The valve is designed to also adjust the height of the flow which is discharged outside of the machine 1.

Advantageously, both the first suction means 4 and the second suction means 7 are of a symmetrical type, that is, they obtain a suction equal from both sides of the machine.

In this way it is possible to obtain a linearity of suction force along the entire width of the machine 1 avoiding as much as possible any imperfections.

Moreover, the double symmetrical suction on both sides of the machine allow a modulating of the right\left suction to correct for any excess\lack of material being made.

The embodiment of the machine 1 shown in the drawings comprises means for moving the conveying surface 5, which are not illustrated in the drawings. These movement means are designed for modifying the operating condition of the conveying surface 5. These movement means are preferably designed to rotate the conveying surface 5 at least on a plane of rotation shared by the licker-in 2 and by the drum 3, as shown clearly in FIG. 2.

This rotation of the conveying surface 5 is performed preferably about a centre of rotation O located, along the working path L, downstream of the conveying surface 5.

One possible solution comprises, on the other hand, the vertical translational movement of the entire conveying surface 5.

Figure 3:
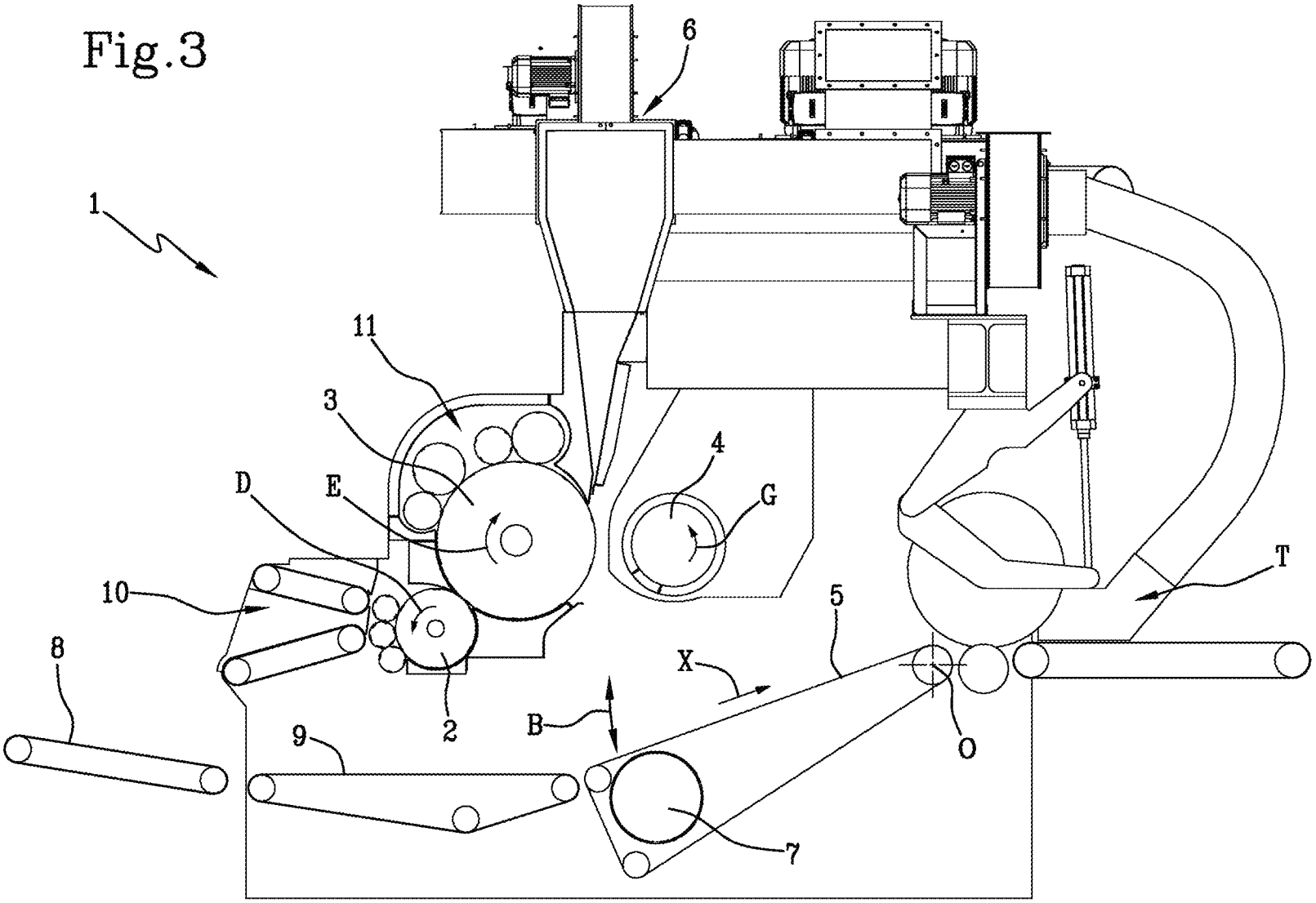
FIG. 3 is a side view of the embodiment in a third operating configuration.

In the embodiment illustrated in the drawings, the rotation occurs according to the double arrow B and about an axis of rotation at a right angle to the plane of FIGS. 1 to 3 and passing through the centre of rotation O.

In FIG. 1 the machine 1 is in a first operating configuration such that the conveying surface 5 adopts a first operating condition. The first operating condition of the conveying surface 5 corresponds to a certain angular position of the conveying surface 5 around the axis of rotation passing through the centre of rotation O.

In FIG. 2 the machine 1 is in a second operating configuration corresponding to a second operating condition of the conveying surface 5. In FIG. 2, the conveying surface 5, relative to its operating condition of FIG. 1, is rotated about the axis of rotation passing through O.

In this second operating configuration of the machine 1 shown in FIG. 2, the distance between the conveying surface 5 and the detaching point from the drum 3 is greater, and thus at least the suction section labelled S is more extended than that shown in FIG. 1.

The aim of varying the sector S may also be achieved by keeping the conveying surface 5 fixed and by modifying the height of the drum 3 and, if necessary, the first suction means 4.

The embodiment of the machine 1 according to the accompanying drawings is shown in FIG. 3 in a third operating configuration, such that the conveying surface 5 is rotated significantly downwards, relative to FIG. 1 or also relative to FIG. 2, again around the axis of rotation passing through O. More specifically, in the situation of FIG. 3 the conveying surface 5 is designed to receive the fibres arriving from an infeed surface 8, located upstream of the licker-in 2 and the drum 3, without the fibres being worked along the working path L.

The infeed surface 8, in the first operating configuration and in the second operating configuration of the machine 1, shown in FIGS. 1 and 2, respectively, is designed to convey the fibres in such a way that they start to travel along the working path L defined by the machine 1.

In the third operating configuration of the machine 1, shown in FIG. 3, the infeed surface 8 is, on the other hand, oriented in such a way as to convey the fibres directly towards the conveying surface 5, so that the fibres are directed towards one of the components of the same plant after the machine 1, without being worked along the working path L.

If necessary, the operating configuration of FIG. 3 also comprises a further intermediate surface 9 which acts as a bridge between the infeed surface 8 and the conveying surface 5.

The conveying surface 5 could be considered, in the embodiment of the machine 1 shown in the accompanying drawings, basically as an outfeed surface of the machine 1, since it is designed to carry the fibres towards the next component after the machine 1 and belonging to the same production plant.

The infeed surface 8 and the intermediate surface 9 are also preferably slidable and/or translatory parallel to themselves, similarly to the conveying surface 5, which as mentioned above is slidable and/or translatory according to the arrow X. In that sense, the infeed surface 8 and/or the intermediate surface 9 and/or the conveying surface 5 may each comprise at least one conveyor belt.

Figure 4:
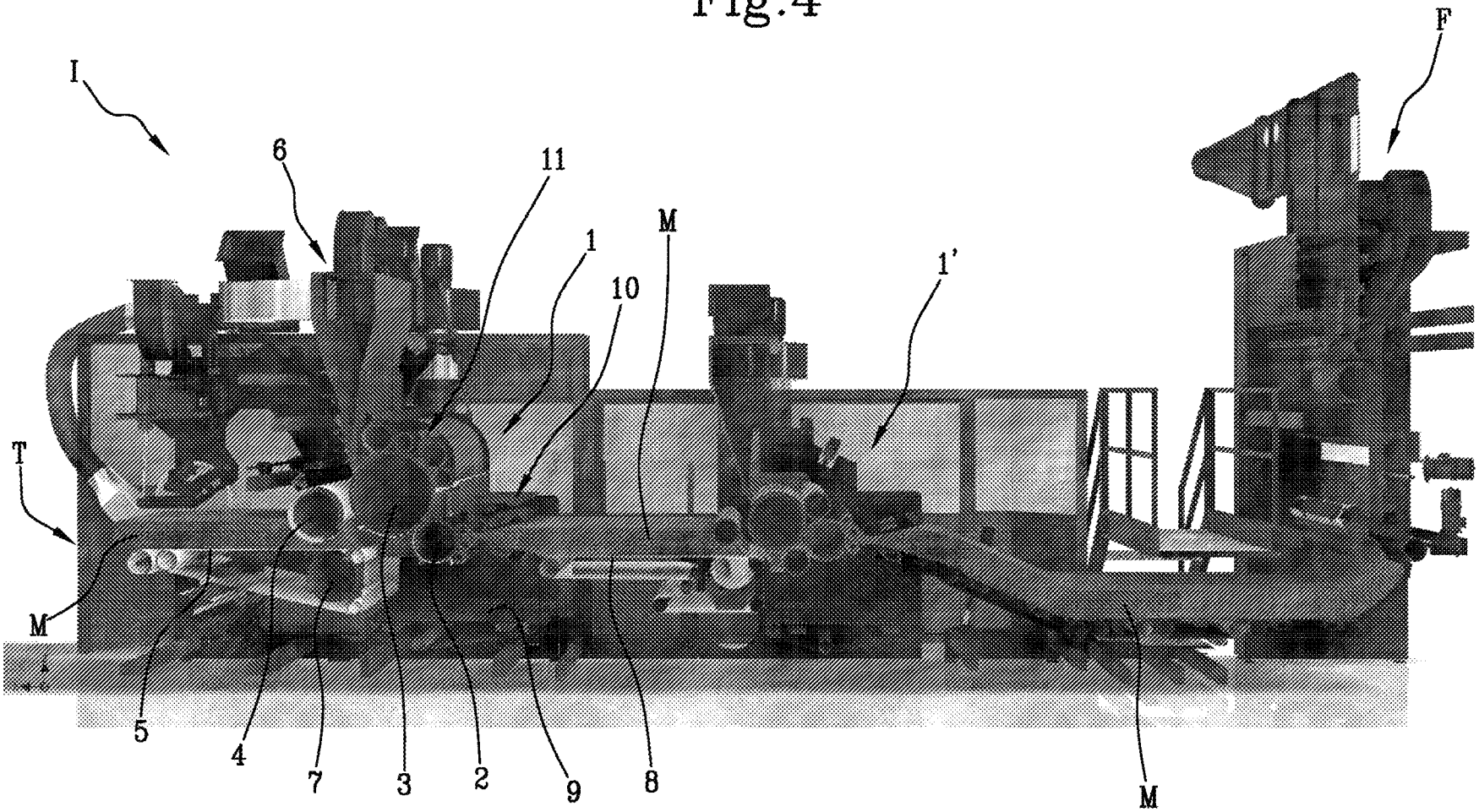
FIG. 4 is a side view of a production system in which the embodiment according to this invention shown in FIGS. 1 to 3 may advantageously operate.

FIG. 4 shows an example of a production plant I in which the embodiment of the machine 1 of FIGS. 1 to 3 can be advantageously used. In the case shown, the plant I comprises, for example, a forming machine F, another carding machine 1', and a cutting unit T. FIG. 4 also shows the fibres of material M which are worked by the machines F, 1' and 1 of the plant I.

The cutting unit T is positioned, in the plant I shown in FIG. 4, after the carding machine 1 according to this invention. The machine 1, in FIG. 4, in an operating configuration such that the fibres are worked by the licker-in 2 and by the drum 3, and then received by the conveying surface 5, similarly to what occurs in operating configurations of FIG. 1 and FIG. 2.

The cutting unit T is also indicated in FIGS. 1 to 3, for reasons of consistency with FIG. 4.

In the embodiment illustrated the machine 1 also comprises introductory means suitable for conveying towards the licker-in 2 the fibres arriving from the infeed surface 8. These introductory means may also advantageously comprise further rotary units, as may be seen in the drawings.

In the embodiment illustrated the machine 1 also comprises rotary doffing and/or working means 11, situated in the proximity of the drum 3, which are preferably designed to work the fibres in conjunction with the drum 3.

A possible method for using a machine 1 according to the embodiment illustrated in the accompanying drawings comprises the rotation of the licker-in 2 and the drum 3 at least om the same shared plane of rotation, which, for example, coincides with that of FIGS. 1 to 3. Moreover, the licker-in 2 and the drum 3 rotate preferably in a mutually inverse manner, and, in the embodiment illustrated, according to arrows D and E, respectively. The direction of translation X of the conveying surface 5 and the working path L of the fibres, according to this method, lie at least partly on the shared plane of rotation, or in any case are at least partly parallel to the same plane.

Advantageously, the first suction means 4 rotate at least on the shared plane of rotation. In the embodiment illustrated, the first suction means 4 rotate according to the arrow G.

The invention makes it possible to achieve the preset aims.

The possibility of changing the operating condition of the conveying surface 5 (that is to say, varying the size of the sector S) makes it possible to add an extra variable to adjust the type of processing which can be obtained using the machine 1, and in general the effects of the machine 1 on the fibres.

The type of movement which is imparted by the movement means to the conveying surface 5, in order to vary the operating condition, makes it possible to configure the movement means themselves in such a way as to reduce the dimensions, especially for the purposes of integrating the movement means between the other components of the machine 1 and/or the plant I.

The invention claimed is:

1. A carding machine comprising a rotary element or drum, first suction means and a conveying surface designed to form a path for working the fibres, the path being tangential partly to the drum and partly to the conveying surface, the conveying surface being designed to receive fibres arriving from the drum and translating them along at least one direction of translation, the working path comprising a suction sector interposed at least partly between the first suction means- and the conveying surface, characterised in that the conveying surface may adopt several operating conditions, the variation of the operating condition of the conveying surface being associated with the variation in distance between the first suction means and the conveying surface.

2. The carding machine according to claim 1, also comprising second suction means the first suction means being designed to act at the suction sector and above the second suction means.

3. The machine according to claim 1, wherein the variation of the operating condition adopted by the conveying surface is associated with the variation of the distance between a point of separation from the drum and the conveying surface.

4. The machine according to claim 1, wherein the working path comprises an intermediate sector (C) designed to be passed along by the action of gravity by fibres coming from the drum in such a way that the fibres reach the suction sector.

5. The machine according claim 1, comprising blower means designed to act at the intermediate sector, the blower means facing towards the conveying surface in such a way as to push the fibres towards the conveying surface.

6. The machine according to claim 1, wherein the first suction means comprise a first rotary suction device.

7. The machine according to claim 1, comprising pneumatic energy recovery means designed to act between the first suction means and the blower means.

8. The machine according to claim 1, wherein the second suction means- are designed to act at the suction sector (A) and are located on the opposite part of the conveying surface relative to the first suction means.

9. The machine according to claim 1, wherein the energy recovery means are designed to act between the second suction means and the blower means.

10. The machine according to claim 1, comprising means for moving the conveying surface designed to modify the operating condition.

11. The machine according to claim 10, wherein the movement means are designed to rotate the conveying surface at least on a plane of rotation shared by a licker-in and the drum and about a centre of rotation located downstream of the conveying surface along the working path.

* * * * *